US009573746B2

(12) United States Patent
Rud

(10) Patent No.: US 9,573,746 B2
(45) Date of Patent: Feb. 21, 2017

(54) SLIDE AND LOCK PACKAGE

(71) Applicant: SONOCO DEVELOPMENT, INC, Hartsville, SC (US)

(72) Inventor: Diana Kay Rud, Sandwich, IL (US)

(73) Assignee: Sonoco Development, Inc., Hartsville, SC (US)

( * ) Notice: Subject to any disclaimer, the term of this patent is extended or adjusted under 35 U.S.C. 154(b) by 36 days.

(21) Appl. No.: 14/636,827

(22) Filed: Mar. 3, 2015

(65) Prior Publication Data

US 2016/0257471 A1 Sep. 8, 2016

(51) Int. Cl.
*B65D 75/36* (2006.01)
*B65D 65/38* (2006.01)

(52) U.S. Cl.
CPC ..... *B65D 75/366* (2013.01); *B65D 65/38* (2013.01); *B65D 2075/361* (2013.01); *B65D 2075/362* (2013.01); *B65D 2575/363* (2013.01); *B65D 2575/368* (2013.01)

(58) Field of Classification Search
CPC ..... B65D 43/20; B65D 75/366; B65D 65/38; B65D 2075/362; B65D 2575/363; B65D 2575/368; B65D 2075/361
USPC ..... 206/468, 232, 461, 462, 463, 464, 465, 206/467, 471; 220/315, 252, 811, 812, 200/813
See application file for complete search history.

(56) References Cited

U.S. PATENT DOCUMENTS 3,467,248 A 9/1969 Makowicki
4,133,429 A 1/1979 Kuchenbecker
5,129,538 A * 7/1992 Bennett ..... G07G 1/0027 220/315
5,577,629 A * 11/1996 Rosler ..... B65D 43/12 220/345.3
5,944,177 A 8/1999 Nemoto
6,210,638 B1 * 4/2001 Grieco ..... A61L 2/26 220/345.1
6,523,689 B2 2/2003 Mickel
8,328,016 B2 12/2012 Thornton et al.
8,701,889 B2 4/2014 Loftin
8,813,959 B2 8/2014 Hansen et al.
2002/0108878 A1 * 8/2002 Mickel ..... B65D 75/366 206/468
2006/0049073 A1 * 3/2006 Shannon ..... B65D 77/2016 206/459.5
2007/0051726 A1 * 3/2007 Arkins ..... B65D 43/20 220/345.1
2010/0307116 A1 * 12/2010 Fisher ..... B65D 81/2076 53/492
2012/0037534 A1 * 2/2012 Omage ..... B65D 43/12 206/557

* cited by examiner

*Primary Examiner* — Robert J Hicks
*Assistant Examiner* — Kareen Thomas
(74) *Attorney, Agent, or Firm* — Miller, Matthias & Hull LLP

(57) ABSTRACT

A two piece thermoformed container comprising a tray and a lid for holding large and small objects is provided. The container is portable, recloseable and provides easy access to the contents. The tray includes a front wall, rear wall and opposing side walls. Each side wall defines an elongated rib. The lid comprises a rear covering portion, a recessed front covering portion and side walls. The lid side walls form grooves which receive the tray ribs. The lid is moveable in a sliding fashion between a fully closed position in which the lid front portion abuts the tray front wall and a fully opened position in which lid backstops abut the tray rear wall. The lid and tray may remain engaged at all times.

20 Claims, 5 Drawing Sheets

(CLOSED)

(OPEN)

(CLOSED)

(OPEN)

(TRAY)

(LID)

SLIDE AND LOCK PACKAGE

BACKGROUND OF THE INVENTION

Field of the Invention

This disclosure relates to a package having a sliding lid. More particularly, this disclosure relates to a two piece thermoformed container that is portable, recloseable and provides easy access to the contents.

Description of the Related Art

Packages including sliding components for opening and closing the package are known. For example, Makowicki U.S. Pat. No. 3,467,248 discloses a blister package comprising a folded display card 16 defining channels within which a tray 44 can slide. The card 16 includes a locking tab 42 that prevents the tray 44 from being completely removed (col. 3, lines 9-17).

Similarly, Kuchenbecker U.S. Pat. No. 4,133,429 discloses a blister package 10 comprising a paperboard card 14 defining channels within which a blister pack 11 can slide. The card 14 is bendable at 21 (FIG. 2) to allow the blister pack 11 to be removed from the card 14.

Nemoto U.S. Pat. No. 5,944,177 discloses a package comprising a plastic tray 2 and a sliding paperboard mount 3. The mount 3 slides within channels formed along the sides of the tray 2. Cuts 9 located in the mount 3 form engaging pieces 10 which engage the channels in the tray 2 (FIG. 10).

Mickel U.S. Pat. No. 6,523,689 discloses another package comprising a plastic tray 22 and a sliding backing card 24. Sidewall 34 (FIGS. 2 and 6) extends upward from the flange 28, and defines a groove extending at least one third the length of the sidewall.

Thornton U.S. Pat. No. 8,328,016 discloses yet another blister pack and sliding backboard combination. A locking tab 30 on the backboard fits into a slot 38 in the blister pack 14 (FIG. 1) to lock the two components together.

Loftin U.S. Pat. No. 8,701,889 discloses a pill container comprising a base 11, a shell 40 attached to the base 11 that forms a sheath around an insert 20, and a lid 12 hingedly attached to the base 11. When the lid 12 is opened the insert 20 can be slid outward for access to the pills. In one embodiment shown in FIG. 2A the shell has an indexing tab 47 which extends into a cutout area to allow the insert 20 to be withdrawn to a plurality of discrete positions.

U.S. Pat. No. 8,813,959 discloses a container having a lid 40 that slides within a channel 18 formed between a plastic tray flange 14 and a third component, a paperboard panel 30 (FIG. 5A).

There remains a need for a container that can hold large and small objects, is portable, recloseable and provides easy access to the contents. The present disclosure addresses those needs.

BRIEF SUMMARY OF THE INVENTION

The present disclosure relates to a two piece thermoformed container that can hold large and small objects. The container comprises a tray and a lid and is portable, recloseable and provides easy access to the contents.

The tray comprises a bottom wall having a periphery. Side walls, a front wall and a rear wall extend upward from the periphery and terminate in a rim that defines an opening. The tray further comprises a flange extending outwardly from the rim.

More particularly, each tray sidewall may comprise a lower section extending upward from the bottom wall to an inner edge, a substantially horizontal ledge extending outward from the inner edge and terminating in an outer edge, and an upper section extending upward from the outer edge and terminating at the rim. The upper section includes an elongated rib extending inwardly from each side wall above and substantially parallel to the ledge. The tray may have dimple stops extending upward from the ledge near each side wall and near the front wall.

The lid comprises a cover portion that covers the opening and a flange that extends outward from the periphery of the cover portion. The cover portion comprises a rear cover portion and a front cover portion. The rear cover portion may be substantially flat and defines a plane. The front cover portion may be tray shaped and comprises a recessed back wall extending downward from a front edge of the rear cover portion, and a recessed front wall and recessed side walls extending downward from the top wall periphery. A recessed cover portion extends between the recessed front wall, recessed back wall and recessed side walls. The recessed cover portion may include one or more dimples configured to receive and mate with the dimple stops on the tray to lock the lid in the closed position before and after each use. Each recessed side wall defines a groove configured to receive one of the elongated ribs in the tray side walls to secure the lid to the tray in sliding fashion. The lid may comprise backstops integrally formed in the recessed back wall.

The lid is moveable in a sliding fashion between a fully closed position in which the recessed front wall of the lid abuts the tray front wall, and a fully opened position in which the one or more backstops abut the tray rear wall.

DETAILED DESCRIPTION OF THE INVENTION

Figure 1:
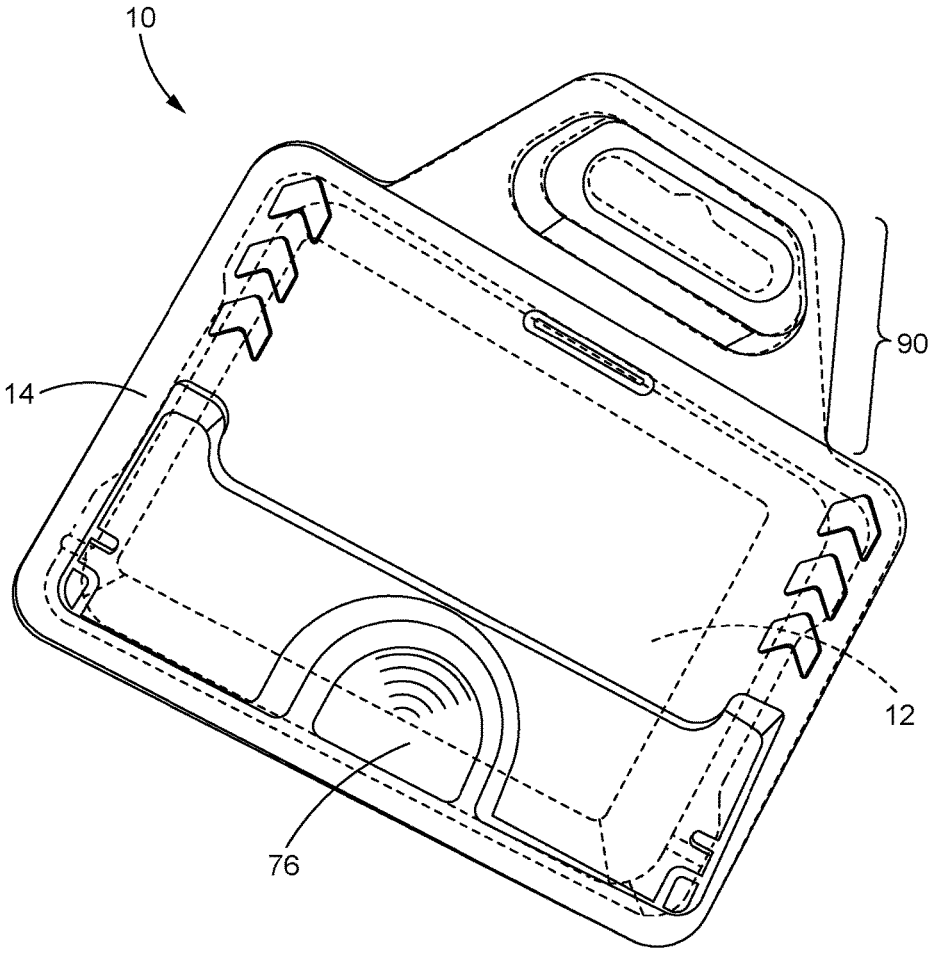
FIG. 1 is perspective view of a package according to the disclosure shown in the closed position, comprising a tray and lid.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments. When first and second opposing mating structures are described as being part of the tray and lid respectively, such as dimples and dimple stops or ribs and grooves, it should be understood that the structures may be reversed, so that the structure formed in the tray may instead be formed in the lid, and vice versa.

Turning to the drawings, there is shown in FIG. 1 one embodiment of the present invention, a two piece thermoformed container 10 that can hold large and small objects. The container 10 is portable, recloseable and provides easy access to the contents.

Figure 2:
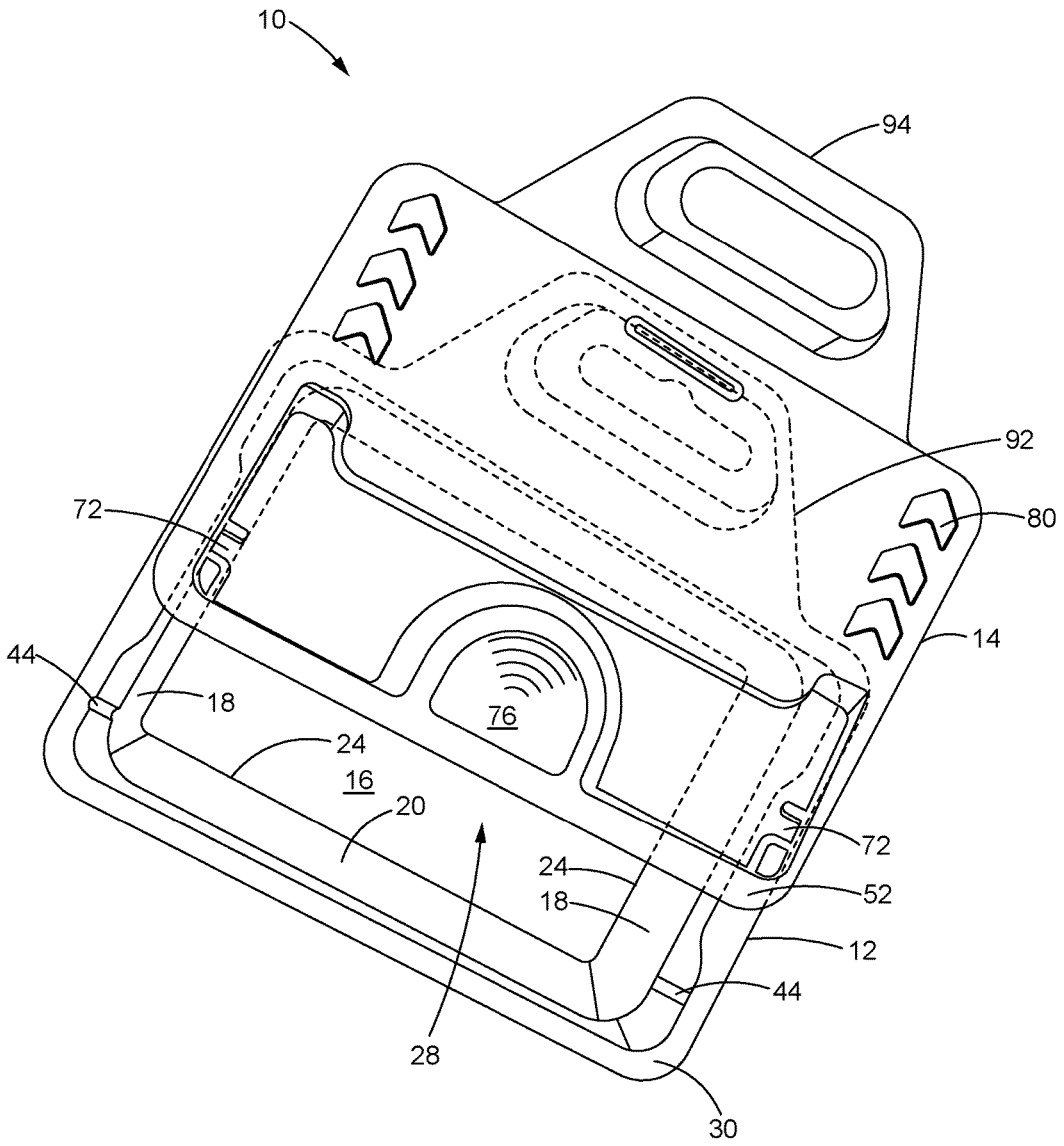
FIG. 2 is perspective view of the package of FIG. 1 shown in the open position.

FIG. 1 is a perspective view of the container 10 in the closed position and FIG. 2 is a perspective view of the container 10 in the open position. The container 10 comprises a tray 12 and a sliding lid 14.

Figure 3:
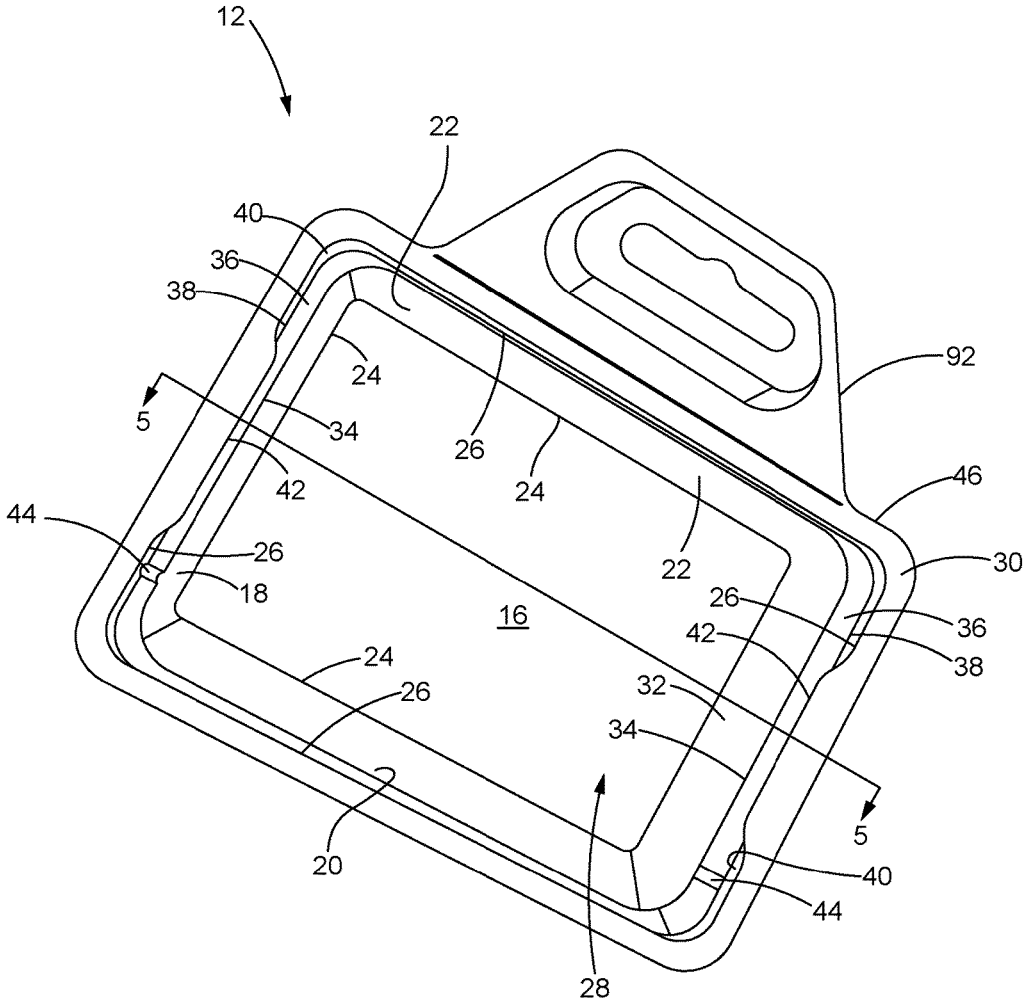
FIG. 3 is perspective view of the tray of FIG. 1.

The tray 12, best shown in FIG. 3, comprises a bottom wall 16, side walls 18, a front wall 20 and a rear wall 22. The side walls 18, front wall 20 and rear wall 22 extend upward from the periphery 24 of the bottom wall 16 and terminate in a rim 26 that defines an opening 28. A flange 30 may extend outwardly from the rim 26.

Figure 5:
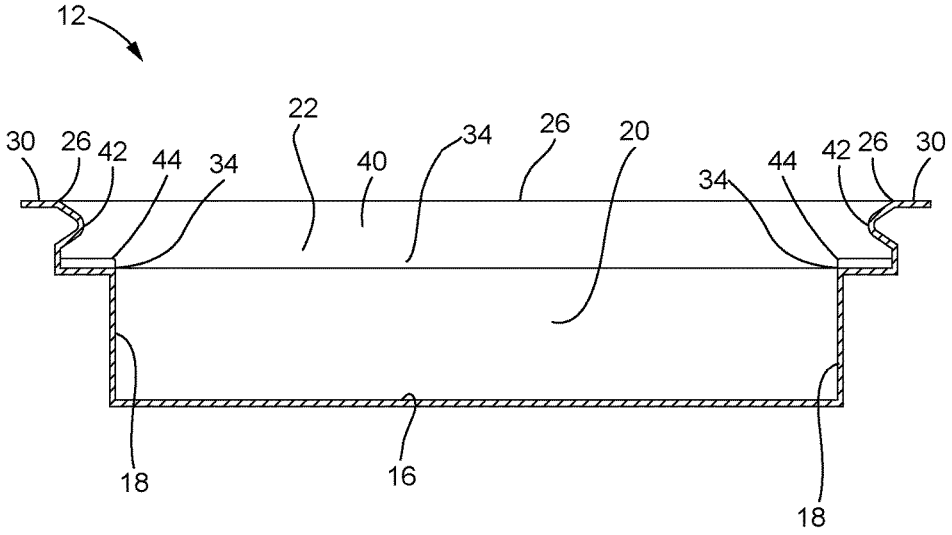
FIG. 5 is a cross-sectional view taken along line 5-5 of FIG. 3.

More particularly, each sidewall 18 may comprise a lower section 32 extending upward from the bottom wall periphery 24 to an inner edge 34, a ledge 36 extending outward from the inner edge 34 and terminating in an outer edge 38, and an upper section 40 extending upward from the outer edge 38 and terminating at the rim 26. As perhaps best shown in FIG. 5, the upper section 40 of each side wall 18 includes an inwardly extending elongated rib 42 running front to back. The elongated rib 42 extends inwardly from each side wall 18 above and substantially parallel to the ledge 36. A dimple stop 44 extends upward from each ledge 36 near the container front wall 20. The flange may have a rear edge 46.

Figure 4:
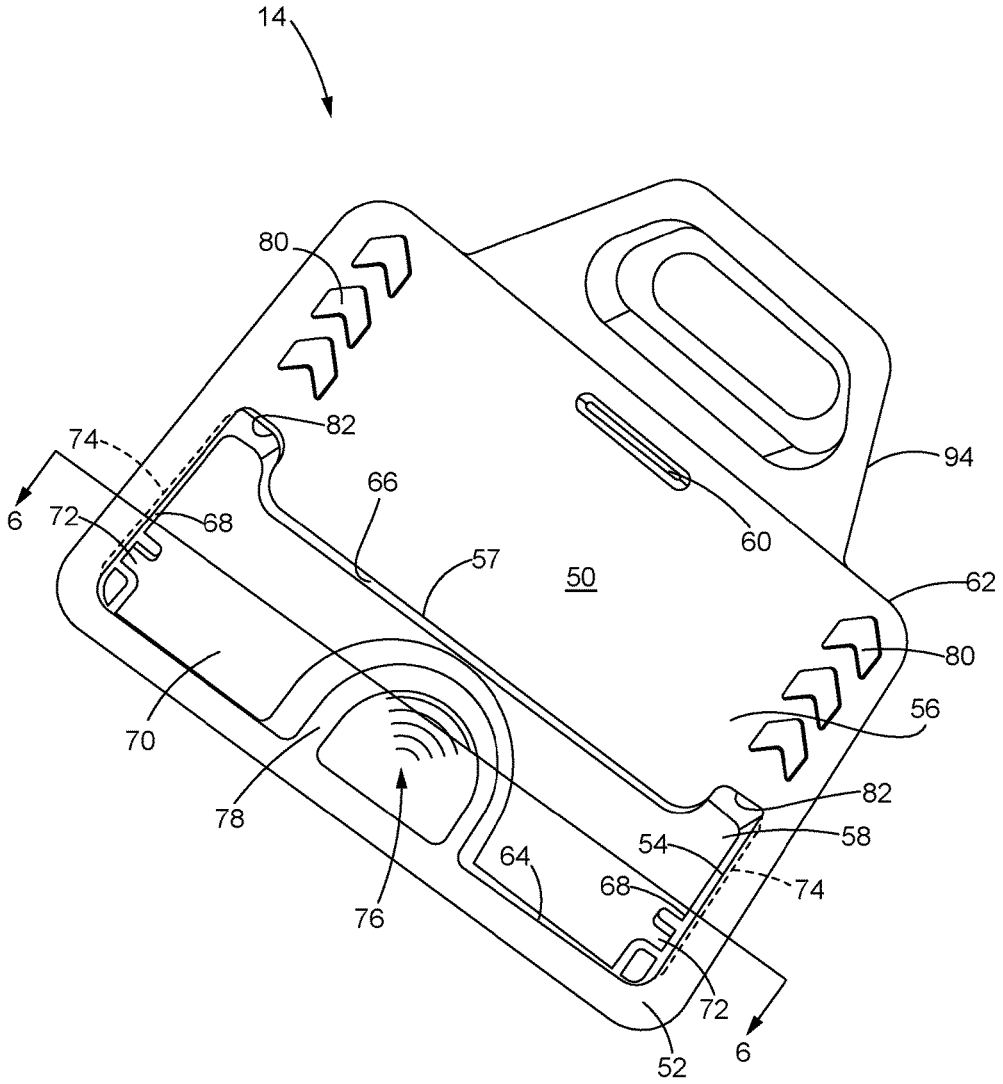
FIG. 4 is perspective view of the lid of FIG. 1.

The lid 14, best shown in FIG. 4, comprises a cover portion 50 that covers the opening 28 and a flange 52 that extends outward from the periphery 54 of the cover portion 50 and includes a lid rear edge 62. The cover portion 50 may comprise a substantially planar rear cover portion 56 defining a plane and a front cover portion 58 that is recessed below the plane of the rear cover portion 56. The rear cover portion 56 may include a front edge 57 and a downward extending ridge 60 located near and parallel to the lid rear edge 62. The ridge 60 abuts the rear wall 22 of the tray 12 when the container 10 is closed.

The front cover portion 58 comprises a recessed front wall 64, a recessed back wall 66 extending downward from the front edge 57 of the rear cover portion 56, recessed side walls 68 and a recessed cover portion 70 extending between the recessed front wall 64, recessed back wall 66 and recessed side walls 68. The recessed front wall 64 and recessed side walls 68 may extend downward from the top wall periphery 54. The recessed cover portion 70 may include dimples 72 near the recessed side walls 68 and configured to receive and mate with the dimple stops 44 to help lock the lid 14 in the closed position before and after each use.

Figure 6:
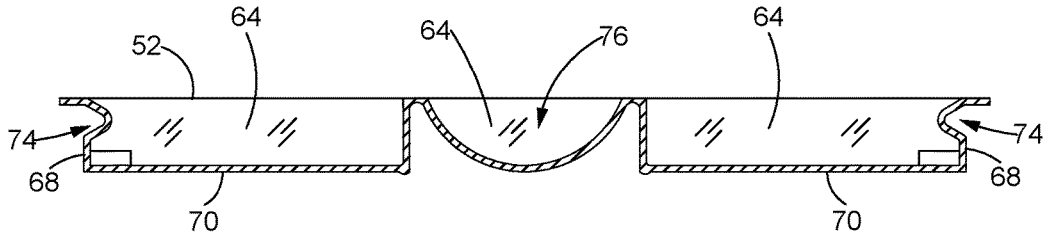
FIG. 6 is a cross-sectional view taken along line 6-6 of FIG. 4.

As perhaps best shown in FIG. 6, each recessed side wall 68 defines a groove 74. The grooves 74 receive the elongated ribs 42 in the tray 12 to secure the lid 14 to the tray 12 in sliding fashion. An optional thumb depression 76 located in the front portion 58 of the lid 14 may be used to open the container 10 as explained below. The thumb depression 76 may be defined by a raised curved ridge 78 extending upward from the recessed cover portion 70 but not above the plane of the rear cover portion 56. Indicia 80 such as arrows may be embossed or otherwise formed on the lid 14 to add structure and thus stability to the lid 14 and to indicate the direction of movement of the lid 14 during opening and/or closing.

One or more optional backstops 82 may extend rearward from the recessed back wall 66. These backstops 82 abut the tray rear wall 22 when the lid is on the fully open position, thus limiting the rearward movement of the lid 14 with respect to the tray 12 and preventing the lid 14 from being fully separated from the tray 12. The backstops 82 may be integrally formed with the recessed back wall 66 and form part of the back wall 66.

An optional two piece hang tab 90 may be included with the container 10 and may comprise a tray tab 92 extending rearward from the tray flange 30 and a lid tab 94 extending rearward from the rear edge 62 of the lid 14. The tray tab 92 and lid tab 94 have complementary shapes so they fit together in close abutting engagement. They may be spot sealed together before the first use. The tray tab 92 and the lid tab 94 may be attached to the tray 12 and lid 14 respectively along hinge lines to allow the tabs 92, 94 to flex with respect to the rest of the container 10. The hinge lines may be perforated or otherwise weakened to allow the hang tab 90 to break off before use.

To open the container 10, a user pushes the lid 14 rearward with respect to the tray 12, typically by placing her thumb in the depression 76 and exerting a rearward force on the lid 14 while holding the tray 12 with her fingers. As she does this, the spot seals, if any, on the hang tab 90 break, the rear portion of the lid 14 flexes slightly upward to allow the ridge 60 in the lid 14 to ride over the tray rear wall 22 (temporarily distorting the lid 14 in the process), and the dimples 72 in the lid 14 release from the dimple stops 44 in the tray 12, the latter two actions being enabled by the flexibility of the tray 12 and lid 14. All the while the tray ribs 42 remain engaged within the lid grooves 74. The lid 14 may be slid rearward until the lid back wall 66 or backstops 82 abut the rear wall 22 of the tray 12 as shown in FIG. 2. As the lid 14 moves with respect to the tray 12, the lid flange 52 slides across and remains in contact with the top of the tray flange 30.

To reclose the container 10 the user again places a thumb or finger in the depression 76 and slides the lid 14 forward until the ridge 60 in the lid 14 rides forward over the tray rear wall 22 and the dimple stops 44 re-engage the dimples 72. When used properly, the lid 14 remains engaged to the tray 12 at all times. In other words, when the lid is in the fully opened position with the lid back wall 66 or backstops 82 abutting the tray back wall 22, the tray ribs 42 still at least partially engage the grooves 74 on either side of the lid 14. To achieve this "permanent" tray-lid engagement, the distance between the forward end of each groove 74 (the end nearest the recessed front wall 64) and the recessed back wall 66 or backstops 82 must exceed the distance between the rear end of each rib 42 (the end nearest the tray rear wall 22) and the tray rear wall 22. However, due to the flexibility of the tray 12 and lid 14, the two components may be disengaged (separated) if desired.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A recloseable container comprising:

a thermoformed tray comprising a bottom wall, side walls, a front wall and a rear wall, the bottom wall having a periphery, the side walls, front wall and rear wall each extending upward from the periphery and terminating in a rim that defines an opening, the tray further comprising a flange extending outwardly from the rim, the tray including an elongated rib extending inwardly from each side wall; and a thermoformed lid comprising a cover portion that covers the opening and a lid flange that extends outward from a periphery of the cover portion and has a rear edge, the cover portion comprising a rear cover portion defining a plane and a front cover portion, the front cover portion comprising a recessed back wall extending downward from the rear cover portion, a recessed front wall and recessed side walls extending downward from the top wall periphery, and a recessed cover portion extending between the recessed front wall, recessed back wall and recessed side walls, each recessed side wall defining a groove configured to receive one of the elongated ribs in the tray to secure the lid to the tray in sliding fashion; wherein the lid is moveable in a sliding fashion between a fully closed position in which the recessed front wall of the lid abuts the tray front wall, and a fully opened position in which the recessed back wall abuts the tray rear wall.

2. The recloseable container of claim 1 wherein:

the lid is engaged to the tray in both the fully closed and fully opened positions.

3. The recloseable container of claim 1 wherein:

when the lid is in the fully opened position the tray ribs at least partially engage the grooves on either side of the lid.

4. The recloseable container of claim 1 wherein:

the distance between the forward end of each groove and the recessed back wall exceeds the distance between the rear end of each rib and the tray rear wall.

5. The recloseable container of claim 1 wherein:

as the lid moves with respect to the tray, the lid flange slides across and remains in contact with the tray flange.

6. The recloseable container of claim 1 wherein:

the lid further comprises one or more backstops integrally formed in the recessed back wall.

7. The recloseable container of claim 1 wherein:

each sidewall comprises a lower section extending upward from the bottom wall periphery to an inner edge, a ledge extending outward from the inner edge and terminating in an outer edge, and an upper section extending upward from the outer edge and terminating at the rim; and the elongated rib extends inwardly from the upper section.

8. The recloseable container of claim 7 wherein:

the tray further comprises one or more dimple stops extending upward from the ledge near the front wall; and the recessed cover portion includes one or more dimples configured to receive and mate with the one or more dimple stops to lock the lid in the closed position before and after each use.

9. The recloseable container of claim 1 wherein:

the recessed cover portion comprises an upwardly extending ridge that defines a thumb depression.

10. The recloseable container of claim 1 wherein:

the tray further comprises a tray tab extending rearward from the tray flange; and the lid further comprises a lid tab extending rearward from the rear edge of the lid;

the tray tab and lid tab having complementary shapes so they fit together in close engagement.

11. The recloseable container of claim 10 wherein:

the tray tab is attached to the tray along a hinge line; and the lid tab is attached to the lid along a hinge line.

12. The recloseable container of claim 11 wherein:

the tray hinge line and the lid hinge line are each perforated to allow the tray tab and the lid tab to break off before use.

13. The recloseable container of claim 1 wherein:

the rear cover portion includes a downward extending ridge located near and parallel to the lid rear edge, the ridge configured to abut the rear wall of the tray when the container is in the closed position.

14. The recloseable container of claim 13 wherein:

the ridge rides over the tray rear wall as the lid is moved from the fully closed position to the fully open position.

15. A recloseable container comprising:

a thermoformed tray comprising a bottom wall, side walls, a front wall and a rear wall, the bottom wall having a periphery, the side walls, front wall and rear wall each extending upward from the periphery and terminating in a rim that defines an opening, the tray further comprising a flange extending outwardly from the rim, each sidewall comprising a lower section extending upward from the bottom wall periphery to an inner edge, a ledge extending outward from the inner edge and terminating in an outer edge, and an upper section extending upward from the outer edge and terminating at the rim, the upper section including an elongated rib extending inwardly from each side wall above and substantially parallel to the ledge, the tray further comprising one or more dimple stops extending upward from the ledge near the front wall; and a thermoformed lid comprising a cover portion that covers the opening and a lid flange that extends outward from a periphery of the cover portion and is in sliding contact with the tray flange, the cover portion comprising a rear cover portion defining a plane and a front cover portion, the front cover portion comprising a recessed back wall extending downward from the rear cover portion, a recessed front wall and recessed side walls extending downward from the top wall periphery, and a recessed cover portion extending between the recessed front wall, recessed back wall and recessed side walls, the recessed cover portion including one or more dimples configured to receive and mate with the one or more dimple stops to lock the lid in the closed position before and after each use, each recessed side wall defining a groove configured to receive one of the elongated ribs in the tray to secure the lid to the tray in sliding fashion, the lid further comprising one or more backstops integrally formed in the recessed back wall; wherein the lid is moveable in a sliding fashion between a fully closed position in which the recessed front wall of the lid abuts the tray front wall, and a fully opened position in which the one or more backstops abut the tray rear wall; and the lid is engaged to the tray in both the fully closed and fully opened positions.

16. The recloseable container of claim 15 wherein:

the recessed cover portion comprises an upwardly extending ridge that defines a thumb depression.

17. The recloseable container of claim 16 wherein:

the tray further comprises a tray tab extending rearward from the tray flange; and the lid further comprises a lid tab extending rearward from the rear edge of the lid;

the tray tab and lid tab having complementary shapes so they fit together in close engagement.

18. The recloseable container of claim 17 wherein:

the tray tab is attached to the tray along a hinge line; and the lid tab is attached to the lid along a hinge line.

19. The recloseable container of claim 18 wherein:

the rear cover portion includes a downward extending ridge located near and parallel to the lid rear edge, the ridge configured to abut the rear wall of the tray when the container is in the closed position.

20. A recloseable container comprising:

a thermoformed tray comprising a bottom wall, side walls, a front wall and a rear wall, the bottom wall having a periphery, the side walls, front wall and rear wall each extending upward from the periphery and terminating in a rim that defines an opening, the tray comprising a flange extending outwardly from the rim, the tray defining a groove in each side wall; and a thermoformed lid comprising a cover portion that covers the opening and a lid flange that extends outward from a periphery of the cover portion and has a rear edge, the cover portion comprising a rear cover portion defining a plane and a front cover portion, the front cover portion comprising a recessed back wall extending downward from the rear cover portion, a recessed front wall and recessed side walls extending downward from the top wall periphery, and a recessed cover portion extending between the recessed front wall, recessed back wall and recessed side walls, each recessed side wall comprising a rib configured to engage the groove in one of the tray side walls to secure the lid to the tray in sliding fashion; wherein the lid is moveable in a sliding fashion between a fully closed position in which the recessed front wall of the lid abuts the tray front wall, and a fully opened position in which the recessed back wall abuts the tray rear wall.

* * * * *